US008919566B2

(12) United States Patent
Golovanevskiy

(10) Patent No.: US 8,919,566 B2
(45) Date of Patent: Dec. 30, 2014

(54) METHOD OF SORTING PARTICULATE MATTER

(75) Inventor: Vladimir Arkadievich Golovanevskiy, Parkwood (AU)

(73) Assignee: Curtin University of Technology, Bentley (AU)

( * ) Notice: Subject to any disclaimer, the term of this patent is extended or adjusted under 35 U.S.C. 154(b) by 127 days.

(21) Appl. No.: 13/412,743

(22) Filed: Mar. 6, 2012

(65) Prior Publication Data

US 2012/0199520 A1 Aug. 9, 2012

(30) Foreign Application Priority Data

Sep. 7, 2009 (AU) ..... 2009904302

(51) Int. Cl.
*B03C 1/22* (2006.01)
*B03C 1/033* (2006.01)
*B07C 5/344* (2006.01)

(52) U.S. Cl.
CPC ..... *B03C 1/22* (2013.01); *B03C 1/0332* (2013.01); *B03C 1/0335* (2013.01); *B07C 5/344* (2013.01); *B03C 2201/20* (2013.01)
USPC ..... 209/223.1; 209/214; 209/231

(58) Field of Classification Search
USPC ..... 209/214, 223.1, 225, 231, 631, 636, 209/638
See application file for complete search history.

(56) References Cited

U.S. PATENT DOCUMENTS

| | | | | | |
|---|---|---|---|---|---|
| 3,382,977 | A * | 5/1968 | Fraas | ..... | 209/214 |
| 4,083,774 | A | 4/1978 | Hunter | | |
| 4,781,821 | A * | 11/1988 | Salmi | ..... | 209/214 |
| 4,902,428 | A * | 2/1990 | Cohen | ..... | 210/695 |
| 5,092,986 | A * | 3/1992 | Feistner et al. | ..... | 209/212 |
| 5,394,991 | A * | 3/1995 | Kumagai et al. | ..... | 209/212 |
| 6,068,133 | A * | 5/2000 | Schonfeld et al. | ..... | 209/219 |
| 6,095,337 | A | 8/2000 | Saveliev | | |
| 6,173,840 | B1 | 1/2001 | Pruszko | | |
| 6,629,010 | B2 | 9/2003 | Lieber | | |
| 7,367,457 | B2 * | 5/2008 | Warlitz et al. | ..... | 209/225 |

OTHER PUBLICATIONS

International Search Report of PCT Application No. PCT/AU2010/001154, Oct. 13, 2010.

* cited by examiner

*Primary Examiner* — Joseph C Rodriguez
(74) *Attorney, Agent, or Firm* — Edell, Shapiro and Finnan LLC

(57) ABSTRACT

A method of sorting particulate matter comprises creating an unconstrained monolayer feed stream of particulate matter moving with an initial first trajectory in a gaseous medium, and subjecting the monolayer feed stream while in the gaseous medium to a magnetic field of sufficient strength to influence the trajectory of at least some particles in the feed stream to cause a spread of particle trajectories from the first trajectory. The particles are subsequently sorted and/or collected on the basis of their trajectories.

23 Claims, 4 Drawing Sheets

METHOD OF SORTING PARTICULATE MATTER

CROSS REFERENCE TO RELATED APPLICATIONS

The present application is a continuation of International Application No. PCT/AU2010/001154, filed 7 Sep. 2010 and entitled "A Method of Sorting Particulate Matter," which claims priority to Provisional Australian Application No. AU 2009904302, filed on 7 Sep. 2009 and entitled "A Method of Sorting Bulk Granular Materials." The disclosures of each of the aforementioned applications are incorporated herein by reference in their entireties.

FIELD OF THE INVENTION

The present invention relates to sorting particulate matter based on the magnetic response of the matter.

BACKGROUND OF THE INVENTION

The present invention has its genesis in the consideration of the economics of mining iron ore. There are considerable variations in the types of materials that are in deposits that contain iron ore. The materials are generally in the form of particles and include, by way of example, any one or more of the following types of materials: magnetite, hematite, goethite (vitreous and limonitic), clays, shale, and chert.

An important issue for mine operators is to produce a marketable product or range of products. Marketable products include products that have specified minimum amounts of iron in the products. Marketable products may be blends of any one or more of magnetites, hematites, and goethites sourced from pits in one iron ore deposit or multiple iron ore deposits.

It is known to mine iron ore in large blocks of the ore. In accordance with known mining method, a block of ore, for example 40 m long and 20 m wide by 10 m high and containing 8,000 tons of ore, is analysed for example by chemically analysing samples taken from drill holes in the block that determine, on average whether the ore is (a) high grade, (b) low grade, or (c) waste material. The cut-off between high and low grades is dependent on a range of factors and may vary from mine to mine and in different sections of mines. The block of ore is mined, picked up from a mine pit and transported from the mine pit. The ore is processed inside and outside the mine pit depending on the grade determination. For example, waste ore is used as mine fill, low grade ore is stockpiled or used to blend with high grade ore, and high grade ore is processed further as required to form the marketable product. Accordingly being able to sort bulk granular iron ore into for example the above grades can enhance the economics of the mine.

While the above background and the following description focuses on iron ore as an example of particulate matter it is emphasised that the present invention is not confined in application to iron ore. Moreover, it is also emphasised that the present invention is not confined to particulate matter in the form of bulk granular materials.

SUMMARY OF THE INVENTION

The present invention extends to sorting any particulate matter that responds differently to magnetic fields so that it is possible to differentiate between materials on the basis of the magnetic response of and therefore the types of the materials.

The present invention is based on a realisation that different materials in iron ore deposits have different magnetic susceptibilities and that applying a magnetic field to mined iron ore particles can be used beneficially to separate the particles on the basis of the types of materials, for example the compositions of the materials, thereby making it possible to separate particles on the basis of type, for example composition. More specifically, in a situation in which mined ore particles include particles that contain hematite and particles that contain quartz which respond quite differently to a magnetic field, the present invention makes it possible to separate these types of materials. This is beneficial in terms of producing marketable iron ore products.

The present invention is also based on a realisation that the response of different types of materials to an applied magnetic field can be used more productively to sort the materials if the particles are in a gas rather than supported on a surface such as a conveyor belt, vibrating feeder or other.

Thus embodiments of the invention utilise differences in magnetic susceptibility arising from different physical composition, such as mineralogical and/or elemental composition of the particles to enable sorting of particulate matter on the basis of physical composition. Moreover the differences in physical composition are or can be associated with differences in value of the particles. Therefore by appropriately locating one or more feed chutes, bins or other collection devices in the paths of the trajectories one is able to sort particulate or granular matter, using embodiments of this method, on the basis of product properties and/or value. Further embodiments of the present methods enable a single step process of identifying particles of different physical composition (i.e. products of different value) and separating the particles into batches of like physical composition/value.

The term "particulate matter" as used herein is intended to encompass any matter, material of object whether it be naturally occurring or manmade and which is in the form of discrete particles or granules. Examples include, but are not limited to, mined ores or minerals, grains (such as wheat, rice and barley), and manufactured goods and components.

The terms "matter" and "material" are used herein interchangeably unless excluded by the specific context of use.

The term "physical composition" as used herein is understood to refer to properties, such as one or more of: morphology, microstructure and/or mineralogical, chemical or elemental composition of matter that characterizes the matter and allows the matter to be categorized together or into different categories of matter, and physical composition is assessed herein in relation to these properties.

The term "monolayer" as used herein in the context of particulate matter is understood to refer to a layer of particles having a depth or thickness of one particle.

In broad terms the invention provides a method of sorting particulate matter comprising: subjecting a monolayer of particles of the matter freely moving through a gaseous medium to a magnetic field; and allowing the moving particles to deflect in response to influence of the magnetic field to create a spread of trajectories for the moving particles, wherein the trajectories are indicative of physical composition of the particles thereby enabling sorting of the particles on the basis of their trajectories.

The invention also provides a method of sorting particulate matter comprising: creating an unconstrained monolayer feed stream of particulate matter moving with an initial first trajectory in a gaseous medium; subjecting the monolayer feed stream while in the gaseous medium to a magnetic field of sufficient strength to influence the trajectory of at least some particles in the feed stream to cause a spread of particle trajectories from the first trajectory; and sorting of the particles on the basis of their trajectories.

The method may comprise arranging a bulk supply of particulate matter into the monolayer feed stream of particles.

The method may comprise projecting the monolayer of particles horizontally into the gaseous medium.

In an alternate embodiment the method may comprise projecting the monolayer of particles upwardly into the gaseous medium.

In yet a further embodiment the method may comprise presenting the particles in a free falling monolayer to the magnetic field. The monolayer may be disposed radially about an axis.

The method may comprise drying the particulate matter prior to subjecting the monolayer of particles to the magnetic field.

One suitable gaseous medium is air.

The method may comprise prior to arranging the bulk supply, fractionating the bulk supply into two or more bulk fractionated supplies of particulate matter having different ranges of particle size, wherein the method is applied separately to each fractionated supply.

The method may comprise collecting particles having a specific trajectory or range of trajectories and transporting the collected particles for further processing or handling of the collected particles, as required.

The further processing may comprise, by way of example, size separation. The handling may comprise, by way of example, transporting the particles to a customer.

The particulate matter may be any one or more than one of paramagnetic, ferromagnetic, and diamagnetic matter. However embodiments of the invention the rely on the application of a magnetic field of only sufficient strength to influence the free space trajectories of at least some of the particles in the monolayer. It is understood that the magnetic field may not cause a change in the trajectory of every particle in a monolayer.

Basically, the monolayer feed stream of particles may be in any form that allows exposure of the particles to the magnetic field and allows a response of the particles to the field that enables separation of the moving particles into different downstream trajectories and thereby sorting of the particles into downstream trajectories. A single trajectory or a range of trajectories may be considered to constitute a particle stream. It is envisaged that the freely moving monolayer feed steam will be spread into a continuous spread of trajectories. However depending on the nature of the particulate matter for example if the matter contains particles of sharply defined and widely spread magnetic properties, instead of a continuous spread of trajectories a number of discrete groups of trajectories may be created akin to separate particle streams.

Characteristics, such as strength of and the exposure time in, the magnetic field may be selected as required given the physical composition of matter to be sorted. Where the magnetic field is generated by an electro-magnet, field strength can be varied electronically by varying current flowing through the electro-magnet. The strength of the field acting on the monolayer can also be varied for either an electro-magnet or permanent magnet by varying the distance (i.e. air gap) between the magnet and the monolayer.

The materials may be any materials that respond differently to magnetic fields so that it is possible to differentiate between materials on the basis of the magnetic response and therefore the material type, such as compositions of the materials.

For example, the materials may be bulk granular materials, such as iron ore.

The iron ore particles may be mined iron ore particles.

The invention also provides a method of sorting bulk mined iron ore particles comprising: creating an unconstrained monolayer feed stream of iron ore particles moving with an initial first trajectory in a gaseous medium; subjecting the monolayer feed stream while in the gaseous medium to a magnetic field of sufficient strength to influence the trajectory of at least some particles in the feed stream to cause a spread of particle trajectories from the first trajectory; and sorting of the particles on the basis of their trajectories.

The method may comprise arranging a bulk supply of the iron ore particles into at least one monolayer feed stream of iron ore particles and wherein the unconstrained monolayer feed stream is created from one of the at least one monolayer.

Arranging the bulk supply into at least one monolayer may comprise fractionating the bulk supply into two or more bulk fractionated supplies of iron ore particles having different ranges of particle size, and wherein the unconstrained monolayer feed stream is created from a selected bulk fractionated supply of iron ore particles.

The method may comprise providing the bulk supply as a supply having particles of a size in the range of 1 mm to 100 mm.

The bulk supply may be fractionated into for example size fractions of 2 mm to 6 mm; 6 mm to 32 mm; and 32 mm to 80 mm.

Alternately the unconstrained monolayer feed stream may be created from a fractionated supply having an average maximum particle size to minimum particle size ratio of between 2:1 to 4:1 wherein an average maximum size particle is between two to four times the size of an average minimum size particle.

In a further alternative the unconstrained monolayer feed stream may be created from a fractionated supply having an average maximum particle size to minimum particle size ratio of between 2:1 to 3:1 wherein an average maximum size particle is between two to three times the size of an average minimum size particle.

The magnetic field strength may fall within a range of 1 Tesla to 10 Tesla.

The method may comprise providing particles in the unconstrained monolayer with a velocity of between 1 m/s to 15 m/s when moving through the magnetic field.

The method may comprise providing a field strength varying mechanism capable of varying the field strength of the magnetic field acting on the particles.

The mined ore may be mined by any suitable method and equipment. For example, the ore may be mined by drilling and blasting blocks of ore from a mine pit and transporting the mined ore from the pit by truck and/or conveyors.

By way of further example, the ore may be mined by surface miners moving over a pit floor and transported from the pit by trucks and/or conveyors.

The present invention also provides an apparatus for sorting particulate material comprising: a device capable of forming a monolayer of particles from a bulk supply of the particles; and a sorter capable of exposing a monolayer feed stream of particles of the matter that is freely moving in a gaseous medium to a magnetic field so that motion of at least some of the particles is influenced by the magnetic field to create a spread of particle trajectories, wherein the trajectories are indicative of physical composition of the particles.

The present invention also provides an apparatus for sorting mined iron ore particles comprising: a device capable of forming a monolayer of particles from a bulk supply of the particles; and a sorter capable of exposing a monolayer feed stream of the particles that is freely moving in a gaseous medium to a magnetic field so that motion of at least some of the particles is influenced by the magnetic field to create a spread of particle trajectories, wherein the trajectories are indicative of physical composition of the particles.

The apparatus may comprise a means for forming a feed stream of particulate matter into the moving monolayer feed stream of particles to be sorted in the sorter and a means for transporting the monolayer feed stream to the sorter to be exposed to the magnetic field.

The apparatus may comprise one or more particle collection devices, such as feed chutes, bins, which are capable of being positioned to collect particles of the same trajectory, or of a range of trajectories. That is for example three bins may be provided and positioned to collect particles having trajectories in a first, second and third range of trajectories, respectively. In this instance the apparatus sorts the monolayer of particles into three different batches, where each batch contains particles of the same or like physical composition, but particles in different batches have different physical composition.

The apparatus may comprise a drying apparatus for drying feed particles prior to exposing the feed stream of the particles to the magnetic field.

The apparatus may comprise a delivery device such as a conveyor belt or radial spreader which deliver the monolayer to the magnetic field and which may be controllable to vary feed rate of the monolayer and thus rate of sorting.

The apparatus may further comprise fractionating equipment capable of fractionating on the basis of size, a bulk supply of the particles into separate size fractions and wherein one of the size fractions is used to form the monolayer.

The invention also provides a mining process comprising: mining an ore to produce mined ore particles; fractionating the mined ore on the basis of particle size to form two or more size fractions; forming a monolayer feed stream from one of the size fractions of the ore particles; creating from the monolayer feed stream an unconstrained monolayer feed stream of ore particles moving in a gaseous medium in free space with an initial first trajectory; subjecting the monolayer feed stream while in the gaseous medium in free space to a magnetic field of sufficient strength to influence the trajectory of at least some particles in the feed stream to cause a spread of particle trajectories from the first trajectory; and sorting of the particles on the basis of their trajectories.

BRIEF DESCRIPTION OF THE DRAWINGS

The present invention is described further by way of example only with reference to the accompanying drawings in which.

Like reference numerals have been used to identify like elements throughout this disclosure.

DETAILED DESCRIPTION OF PREFERRED EMBODIMENTS

Figure 1:
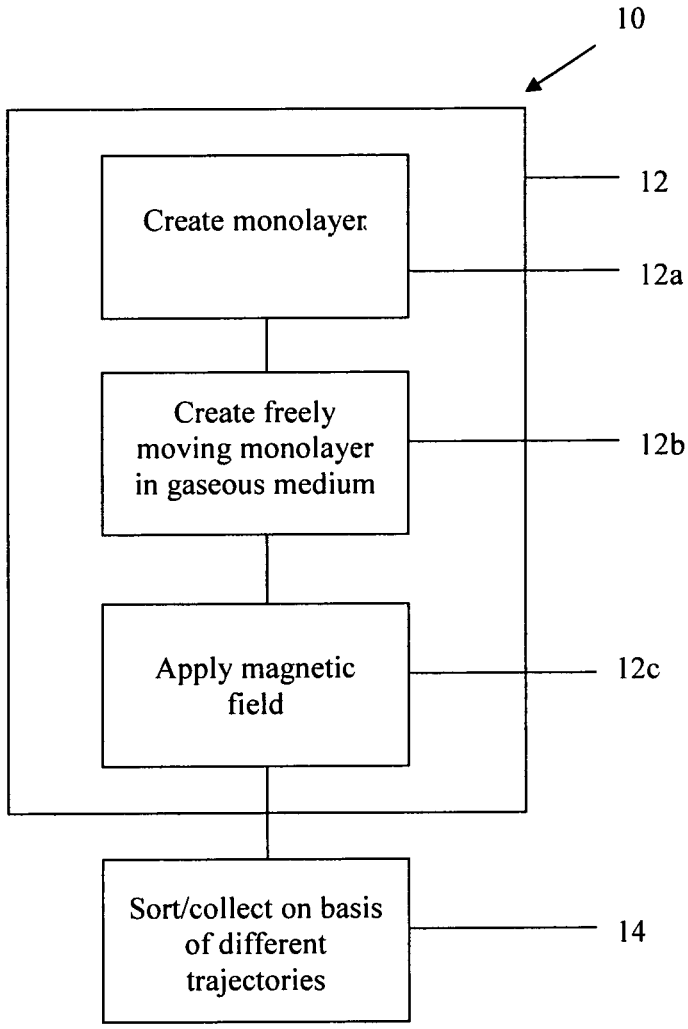
FIG. 1 illustrates a process flow for an embodiment of the present method and apparatus for sorting particular matter.

FIG. 1 is a process flow diagram of an embodiment of a method 10 and corresponding apparatus utilising the method for sorting particulate matter. This illustrated embodiment of method 10 is shown as comprising two over-arching processes or steps namely, a process or step 12 of subjecting a monolayer of particles which are freely moving through a gaseous medium, i.e., a free or open space, to a magnetic field, and process or step 14 of allowing the moving particles to deflect in response to the magnetic field to create a spread of trajectories of moving particles so that the particles can be sorted and/or collected on the basis of the different trajectories. The spread of trajectories arises due to and is indicative of different physical composition of the particles which gives rise to differential effects on the motion of those particles by the magnetic field.

As will be readily understood by the skilled person, a trajectory of an object is generally the path described by such an object moving in air under the influence of such forces as initial velocity, wind resistance, and gravity. Accordingly, in the current arrangement, the trajectory of the particles is generally determined by a velocity at which the particles are introduced into the free space, the angle at which they enter the free space (relative to the horizontal) an influence of the magnetic field on the respective particles, wind resistance and gravity. As will be described in more detail below, the impact of the magnetic field on each particle is dependant on the magnetic susceptibility of such particle as determined by the physical composition of the particle.

The step or process 12 comprises three sub process 12*a*, 12*b* and 12*c*. Process 12*a* is the initial providing or forming of a monolayer stream of particles. As described later below, this may be by way of for example passing a bulk particulate material through a handling machine or device such as a vibrating feeder and subsequently onto a conveyor belt to produce a monolayer feed stream. In this context a monolayer is presented as a distribution of particles across a surface wherein the majority of particles sit one next to the other on the surface and none (or very few) sit on top of other particles.

At step 12*b*, this monolayer feed stream is projected or otherwise delivered so as to flow along an initial trajectory in a gaseous medium in free space. The gaseous medium is most conveniently air. Typically, this free space is enclosed in some manner of building, housing or similar construction. For example, the monolayer feed stream of particles is projected along a trajectory by means of a conveyor into a large, free space inside a building or the like. This now creates a free moving monolayer of particulate matter. The expressions "free flowing", "freely moving" or "unconstrained" in relation to the particulate matter is intended to mean that the matter is able to move without constraint or confinement which may otherwise arise for example by contact with a surface such as a conveyor belt or walls of a cone separator.

In one example, dimensions of the free space may be such that a distance between a point at which the monolayer of particles is delivered or projected into the free space and a point of collection of the particles after being subjected to the magnetic field is greater than 1 m and preferably in the range of 5 m to 25 m. In addition, a height between the point at which the particles are delivered into the free space and a point at which collection occurs is in the range of 0 m to 30 m. As such, it is to be appreciated that, in one example, an influence of the magnetic field on some of the particles, i.e. attraction force, may be such that certain particles may be deflected upwardly, allowing them to be collected at or near the same height at which they are delivered into the free space.

As per the above example, it is to be appreciated that the free space is typically housed inside a suitable building. One reason for this is to allow suitable dust control by enclosing the free space within a building or the like.

Now that the monolayer is freely moving within the free space, at step 12*c*, the freely moving particles are subjected to a magnetic field. The magnetic field will have varying influence on the trajectory of the moving particles. The variation in influence may be between causing a deflection in the motion of the particle towards the magnet, causing a deflection in the motion of the particles away from the magnet, or causing no deflection to the trajectory. On the assumption that the monolayer of particles contains particles having at least two different physical compositions which give rise to different magnetic responses, a spread of particle trajectories will be formed under the influence of the magnetic field. This enables at step 14, the sorting of the particles on the basis of their trajectories and thus their physical composition.

In mining in general it is beneficial in terms of maximising profit to separate low grade particles form high grade target particles. In the context of mining iron ore a low grade particle is a particle with a large proportion of non iron bearing materials such as alumina, silica, and phosphorous. A high grade particle is one with greater than 55% Fe by weight. In a feed stream of mined iron ore particles there will be a spectrum of particles between waste materials, low grade particles and high grade particles. By separating the waste from the low grade and high grade particles the overall average grade of ore recovered from a block/bench of a mine may be increased. Embodiments of the present invention facilitate such separation of different grade particles.

Figure 2:
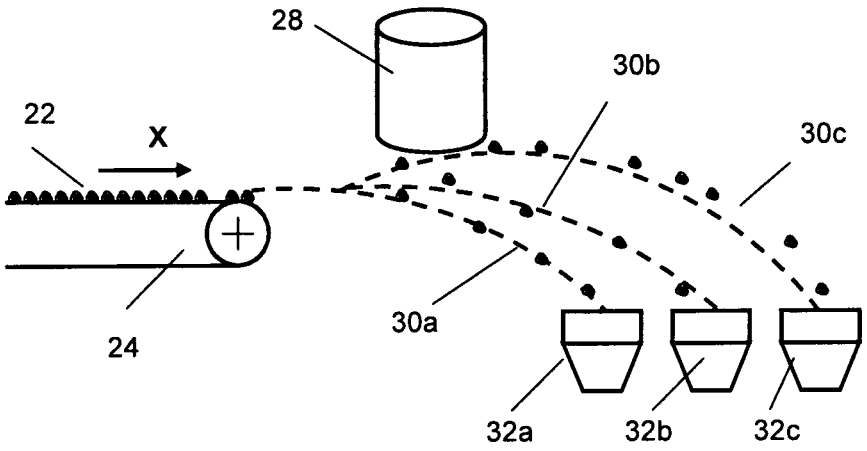
FIG. 2 is a schematic diagram that illustrates one embodiment of a method and an apparatus for sorting iron ore particles in accordance with the present invention.

FIG. 2 illustrates in a very general sense an embodiment of a sorting apparatus 20 capable of sorting particulate matter such as mined iron ore particles in accordance with the method 10.

A monolayer feed stream 22 of mined iron ore particles that includes different types of particles, including particles having different physical compositions, is conveyed along a belt conveyor 24 in a direction of the arrow X in the figure and is projected from end 26 of the conveyor 24 into a free space to create a monolayer feed stream of the particles freely moving along an initial trajectory through the air, the initial trajectory of the feed stream exposing the particles to a magnetic field that is generated by a magnetic field generator 28.

The monolayer feed stream of particles is a freely moving stream of particles in air, whereby the particles have no or minimal contact with other particles or surfaces of equipment or structures as they move through the magnetic field and therefore have maximum freedom to be influenced by the magnetic field.

The magnetic field is selected to have sufficient strength to deflect at least some of the particles in the moving feed stream of particles as a function of the magnetic susceptibilities of the materials of the particles so that the particles form a spread of trajectories. In this example the spread of trajectories is notionally divided into a series of three streams of particles 30*a*, 30*b* and 30*c* where each stream comprises a range of trajectories. The apparatus also comprises three product bins 32*a*, 32*b* and 32*c* into which respective product streams 30*a*, 30*b* and 30*c* fall. Each stream contains particles of the same; or, similar type or composition of material. In the context of mined iron ore particles, the particles in the monolayer will have a range of compositions and the particles in each stream have the same or a known prescribed range of (i.e. similar) composition. Hence, the method makes it possible to sort iron ore particles on the basis of iron ore grade.

For example, different types of iron ore may include magnetite, hematite and/or goethite. As such, the magnetic susceptibility $\chi$ values for these materials, as measured in $10^6$ $cm^3/g$, are typically magnetite—80,000; hematite—290; and goethite—25. Accordingly, an applied magnetic field will have a much more pronounced effect on magnetite than hematite or goethite. Similarly, a magnetic field will have a more pronounced effect on hematite when compared to goethite. Accordingly, if iron ore particles having roughly similar dimensions are subjected to a uniform magnetic field in a free space, a spread of trajectories will be produced according to the physical composition of the particles. Sorting of the particles based on their physical composition can be done simply by selecting a point in this spread or spectrum of trajectories at which to collect the particles. Typical iron ores from the Pilbara region in Western Australia contain mainly Hematite and goethite. Present embodiments can separate high grade hematite particles from low grade and waste particles by causing a deflection of the high grade hematite particles from the trajectory of waste particles.

In an iron ore example, in the spread of particles trajectories produced in this manner, an upper end of the spread may comprise particles with an iron content of +60%, whilst at the other end of the spread are particles with 0% iron content. By partitioning the spread appropriately, it would be possible to, for example, sort the particles into a 0% to 45% iron content pile, a 45% to 55% iron content pile, and a +55% iron content pile, depending on requirements.

The magnetic field generator 28 is arranged to apply a magnetic field uniformly across the width of the freely moving monolayer of particles. The field acts in a direction substantially perpendicular to a predominate direction of motion of the particles. Thus if the predominate direction of motion at the location of the field is horizontal then lines of magnetic flux of the field are directed substantially vertically. When the generator 28 is an electromagnet, the apparatus 20 may include a controller to control the current delivered to the generator 28 to vary the strength of the magnetic field. Alternately, irrespective of whether the generator 28 is an electromagnet or a permanent magnet, apparatus 20 can comprise a mechanism for varying the distance or air gap between the generator 28 and the freely moving monolayer of particles to thereby vary the strengths of the magnetic field applied to the particles.

The method 10 and apparatus 20 are applicable to both dry and wet particulate material. However it is recognised that with wet particulate material, greater difficulty may be involved in initially preparing the monolayer due to mutual adhesion of wet particles. Accordingly, embodiments of method 10 and apparatus 20 also envisage the provision of a drier to dry the particulate matter to a prescribed minimum surface moisture level prior to reaching the magnetic field.

It will be apparent from the above description that method 10 and apparatus 20 enable in effect a single step process of identifying particles of different physical composition and separating the particles on the basis of the different physical compositions. This is to be contrast with other sorting techniques which initially require one process to identify matter of different type or composition and a second process for physically separating the identified products of desired physical composition from a bulk stream of product.

In the embodiment of the apparatus 20 shown in FIG. 2, the spread of trajectories of the monolayer after being influenced by the magnetic generator 28 is divided into three streams each falling into a separate bin. However, as mentioned above, the spread of trajectories can be divided into any number of streams merely dependent on the number of different types of particles desired to be sorted. Further, rather than having the particles fall into product bins, they may fall onto other collecting or materials handling devices such as feed chutes for conveyors, or the like.

Conveyor 24 in apparatus 20 is depicted as running in a horizontal plane or direction and thus projects the monolayer of particles with a horizontal velocity component from the end 26. Rather the conveyor 24 may be inclined or indeed declined relative to the horizontal. In the former case, the monolayer of particles will be projected with a vertically upward velocity component into the magnetic field. Also, the conveyor 24 irrespective of its angle to the horizontal presents the monolayer of particles as a planar layer. However, a monolayer may be created in other shapes and configurations most notably in a radial or circular configuration for example by delivering the monolayer through a cone. In this variation, the monolayer is acted upon after passing through the cone and free falling through air or another gaseous medium. In this instance, a magnetic field generator may be placed either on the inside, or alternately disposed about the outside of the freely moving circular monolayer of particles.

Figure 3:
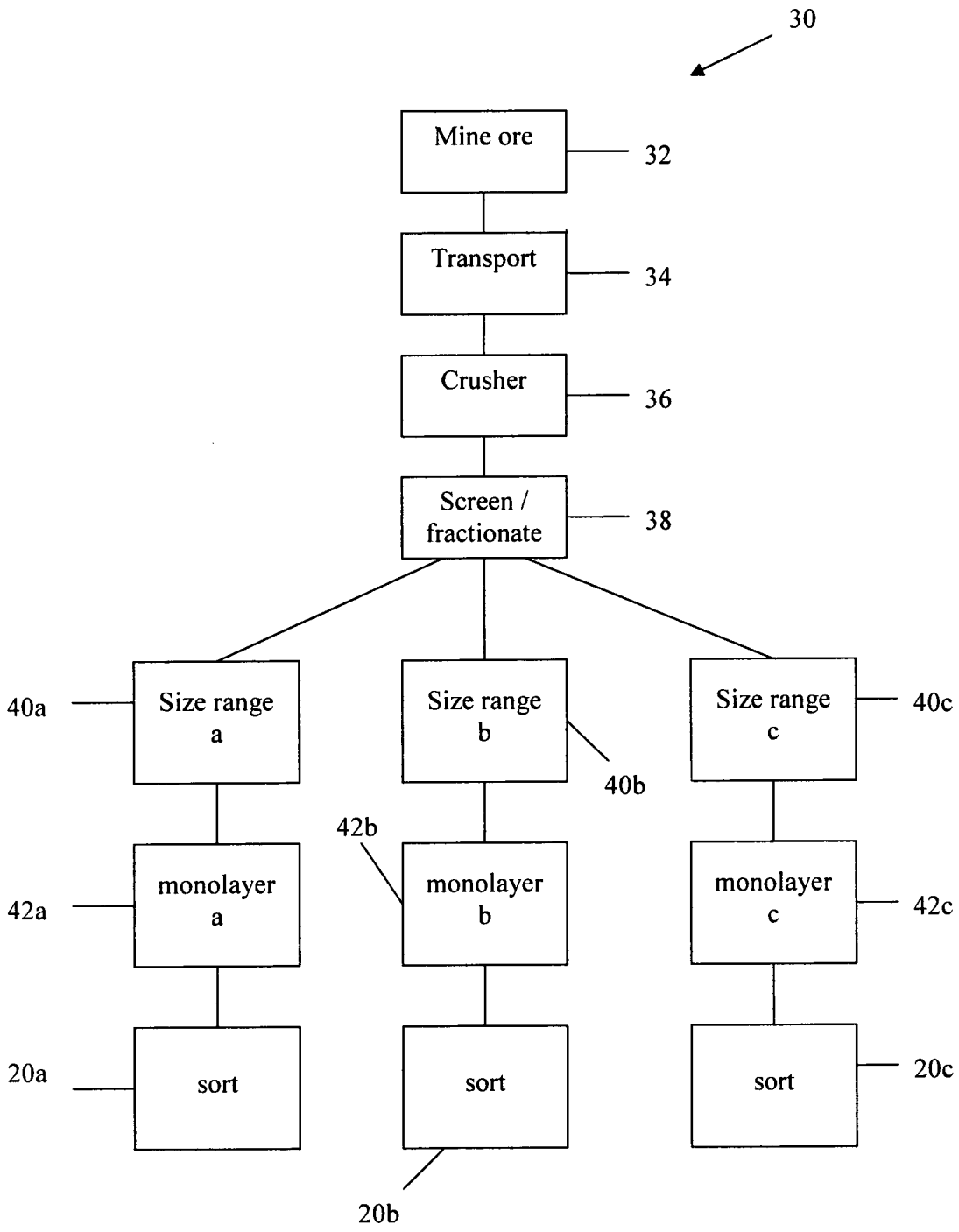
FIG. 3 is a representation of a mining process incorporating an embodiment of the present method and apparatus.

FIG. 3 illustrates an embodiment of a mining process 30 incorporating the method 10 and apparatus 20. An initial stage 32 in process 30 is the mining of a target ore, e.g., iron ore. Any mining method may be used such as drill and blast, or by use of surface mining machines moving over a pit floor.

At stage 34 the mined ore is transported to a crusher 36. The transportation can be by dump truck, conveyor or rail. The crusher 36 crushes the mined ore to produce a bulk particulate ore having a reduced particle size within a predetermined size range, for example from 1 mm to 100 mm. Embodiments of the method 10 and apparatus 20 can be applied to such a range of particle sizes however it is believe that better quality sorting can be achieved by incorporating a screening or fractionation stage 38 which fractionates the bulk particulate ore into a plurality (in this case three) of size fractions. Size fractions can be selected by a process manager or mine manager. The separate size fractions are held in hoppers or stockpiles 40*a*, 40*b* and 40*c*. When it is desired to sort the particles in each hopper/stockpile, the respective particles are passed through device 42, such as a vibration screen which arranges the bulk fractionated particles into a monolayer feed stream for a respective apparatus 20*a*, 20*b*, and 20*c*. Where each apparatus 20*a*, 20*b*, 20*c* accords with and operates on the same basis and principles as apparatus 20 described herein above. Thus, each size fraction is formed into a monolayer feed steam, the particles in each feed stream are subjected to a magnetic field when travelling in an unconstrained manner in free space, and sorted on the basis of trajectory deviation from an initial monolayer trajectory.

As each size fraction naturally has particles of different size ranges, operating parameter of the respective apparatus 20*a*, 20*b* and 20*c* can be set to optimise the spread of respective trajectories and thus the degree or "sharpness" of sorting. The operating parameters include magnetic field strength and speed of travel of the conveyor 24 which corresponds to speed of the monolayer when initially projected or launched into the magnetic field. Indeed the screening/fractionation 38 in process 30 can also be controlled.

In one embodiment of process 30 the size fractions held in hoppers/stockpiles 40*a*, 40*b* and 40*c* may be 2 mm-6 mm; 6 mm-32 mm; 32-80 mm; or 32-100 mm. However, the fractionation may alternately be arranged to provide different size ranges based on particle size ratios. For example, size fractions can be arranged to comprise particles having an average maximum particle size to minimum particle size ratio of about 2:1 to 4:1. In such a size fraction an average maximum size particle is between two to four times the size of an average minimum size particle. Alternatively, this ratio may be in the order of about 2:1 to 3:1.

The magnetic field strength typically lies between the range of 0.5 Tesla to 5 Tesla, although it is believed that up to 10 Tesla may be possible. As such, depending on the requirements and characteristics of the particles to be sorted, a range of 0.5 Tesla to 3 Tesla is also possible. In a further example for an iron ore monolayer feed stream having particles in the size range of either 2 mm to 6 mm or 6 mm to 32 mm, a field strength of 0.5 Tesla to 1.5 Tesla may be appropriate. However, for a particle size range of 32 mm to 100 mm, a field strength of 1.5 Tesla to 5 Tesla may be appropriate. As would be evident to the skilled person, the size of particles and the physical composition thereof will impact on the appropriate field strength required, as larger particles typically require higher field strengths. However, sorting of larger particles comprised of material having a high magnetic susceptibility is possible with a smaller field strength.

In one example the speed of belt 24, and thus the monolayer of particles prior to being presented to the magnetic field is between 1 m/s to 10 m/s though up to 15 m/s may be possible. However, in alternate examples, the speed range is 1 m/s to 8 m/s; or, 2 m/s to 6 m/s. The belt speed can be selected on the basis of the maximum size of particles in the range, with size ranges having smaller maximum sized particles having in general a higher belt speed than size ranges having larger maximum sized particles. For example, for a particle size range of 32 mm to 100 mm, the belt speed is less than or equal to 3 m/s; for 6 mm to 32 mm the speed may be greater than 2 m/s; and for 2 mm to 6 mm the speed may be greater than 4 m/s.

In one example of an application of method 10, apparatus 20 and process 30 in the context of separation of bulk granular iron ore, it is envisaged that the processing rate may be in the order of 250 tonnes/hour/meter of presentation length of the monolayer. Here, the presentation length is the width of a monolayer passing through the magnetic field, for example, the width of the conveyor belt which projects or launches the monolayer feed stream into the free space gaseous medium through which the iron ore particles traverse.

Figure 4:
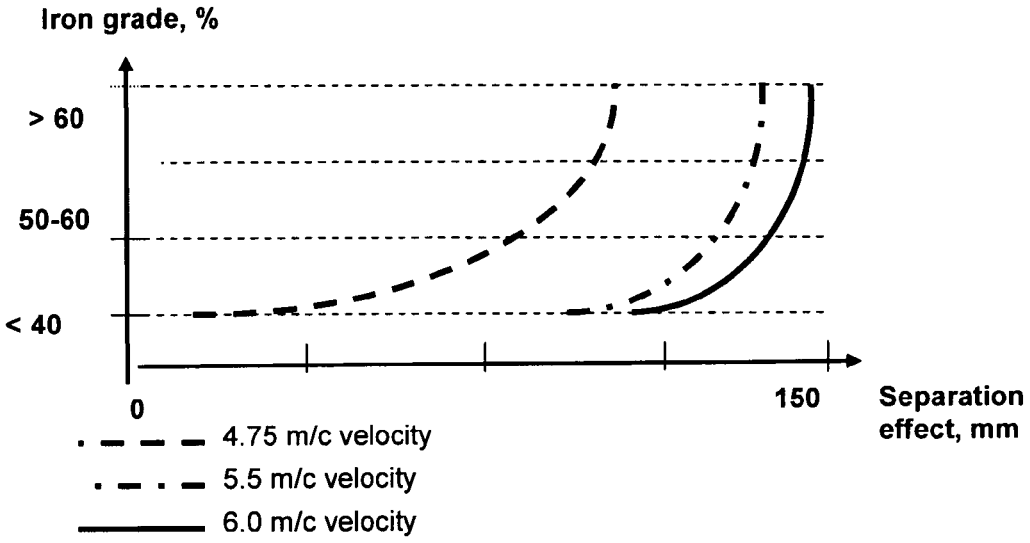
FIG. 4 is a graph illustrating experimental results of application of embodiments of the invention for the sorting of a feed steam of iron ore particles.

FIG. 4 illustrates experimental results of application of an embodiment of the method for sorting a monolayer feed stream of iron ore flowing through air at three different feed stream velocities. The graph indicates the spread of particle trajectories commensurate with different physical composition, in this instance iron content, of the particles. In each of the illustrated examples, the magnetic field density along the width of the feed stream through the air was 0.5 Tl of the magnet was 118 mm in length.

In any given situation, the magnetic field and other operating conditions, such as the mass flow rate of the downwardly moving particles, the size distribution of the particles, the distance and duration of exposure of the particles to the magnetic field, will depend on the magnetic properties of the materials in the particles, and can readily be determined.

Many modifications may be made to the embodiment of the present invention described above without departing from the spirit and scope of the invention.

By way of example, whilst the above-described embodiment is described in the context of sorting iron ore particles, the present invention is not so limited and extends to sorting other bulk granular materials and, more generally, any materials that have different responses to a magnetic field.

By way of further example, embodiments of the method and apparatus enable variation of the magnetic field strength to control the spread of trajectories and thus the fall points or collection points of particles of various trajectories or range of trajectories to thus control where the sorted particles fall. Thus, in the above description while the option is described of moving for example bins 32 to enable collection of particles of the same or similar type, one may instead maintain the bins in a fixed position and vary the field strength to ensure that particles having the same or desired characteristics fall into a specific bin.

In general terms, the present invention extends to any combination of structure and operating conditions that make it possible to form particles into a monolayer feed stream of the particles and to separate the particles into different streams in response to an applied magnetic field and to collect the separate streams for downstream processing of the particles, as required.

It is regarded as advantageous that the current arrangement provides for a means whereby a particulate material can be sorted depending on a magnetic susceptibility of the material. Particularly, the current arrangement allows for the production of a spread of trajectories of particles comprising the material to facilitate the sorting of the material. Instead of only being able to sort the material into magnetic and non-magnetic particles, the current arrangement enables grade-level sorting wherein the spread of trajectories can be apportioned according to requirements. This grade-level sorting removes the need for additional sorting with associated savings in time and costs.

I claim:

1. A method of sorting particulate matter comprising:

creating an unconstrained monolayer feed stream of particulate matter moving with an initial trajectory in a gaseous medium, wherein the particulate matter comprises particles having an average maximum size to average minimum size ratio between 2:1 to 4:1;

subjecting the monolayer feed stream while in the gaseous medium to a constant in time magnetic field of sufficient strength to influence the trajectory of at least some particles in the feed stream on the basis of the magnetic susceptibility of the particles to cause a spread of particle trajectories from the trajectory, wherein the magnetic field is arranged to influence the trajectory of the at least some particles in a manner to deflect the at least some particles upwardly with respect to the initial trajectory; and, sorting of the particles on the basis of their trajectories.

2. The method according to claim 1 comprising arranging a bulk supply of the particulate matter into the monolayer feed stream of particulate matter.

3. The method according to claim 2 comprising prior to arranging the bulk supply, fractionating the bulk supply into two or more bulk fractionated supplies of particulate matter having different ranges of particle size, wherein the method is applied separately to each fractionated supply.

4. The method according to claim 1 comprising providing the particulate matter as particles having a size of between 1 mm to 100 mm.

5. The method according to claim 1 wherein the monolayer is provided with a velocity of between 1 m/s to 10 m/s.

6. The method according to claim 1 wherein the magnetic field has a field strength of between 0.5 Tesla to 10 Tesla.

7. The method according to claim 1 comprising separately handling particles having the same trajectory or a common range of trajectories.

8. The method according to claim 7 wherein separately handling comprises collecting the particles in separate collection devices.

9. The method according to claim 1 comprising providing the particulate matter as particles of mined iron ore so that the unconstrained monolayer feed stream is a feed stream of iron ore particles.

10. The method according to claim 9 wherein the magnetic field has a field strength of between 0.5 Tesla to 10 Tesla.

11. The method according to claim 9 comprising providing particles in the unconstrained monolayer with a velocity of between 1 m/s to 10 m/s when moving through the magnetic field.

12. An apparatus for sorting particulate matter comprising:

a device capable of forming, from a bulk supply of particulate matter wherein the particles comprise particles having an average maximum size to average minimum size ration between 2:1 to 4:1, an unconstrained monolayer of particles moving through a gaseous medium, a sorter comprising a magnet arranged to generate a constant in time magnetic field, the sorter capable of exposing the monolayer feed stream of particles that is moving in the gaseous medium to the magnetic field so that motion of at least some of the particles is influenced by the magnetic field on the basis of the magnetic susceptibility of the particles to create a spread of particle trajectories, wherein the trajectories are indicative of physical composition of the particles; and wherein the magnet is located relative to the monolayer feed stream of particles that is moving in the gaseous medium such that the influence on the motion of at least some of the particles includes an upward deflection.

13. The apparatus according to claim 12 wherein the device comprises a mechanism capable of launching a monolayer of the particles into the gaseous medium to create the unconstrained monolayer.

14. The apparatus according to claim 13 wherein the magnetic field generator is spaced from the device.

15. The apparatus according to claim 12 comprising a plurality of collection devices, one for respective groups of particles of the same trajectory or having a selected range of trajectories.

16. The apparatus according to claim 12 comprising fractionating equipment capable of fractionating on the basis of size, a bulk supply of the particles into separate size fractions and wherein one of the size fractions is used to form the monolayer.

17. The method according to claim 1 wherein sorting the particles comprises arranging the spread of trajectories such that particles in the spread of trajectories can be collected at or near the same height at which the unconstrained monolayer is initially created.

18. The method according to claim 1 wherein creating the unconstrained monolayer comprises using a mechanism to launch a monolayer of the particles into the gaseous medium to create the unconstrained monolayer the method further comprising: disposing a magnet for producing the magnetic field at a location in a general direction of the initial trajectory and spaced from the mechanism and wherein at least some of the particles in the spread of trajectories are carried in those trajectories beyond the magnet.

19. A method of sorting particulate matter comprising:

launching an unconstrained monolayer feed stream of particulate matter moving with an initial trajectory in a gaseous medium from an end of a conveyor and toward a magnet spaced from the end of the conveyor wherein the particulate matter comprises particles having an average maximum size to average minimum size ratio of between 2:1 to 4:1;

subjecting the monolayer feed stream while in the gaseous medium to a constant in time magnetic field produced by the magnet to cause a spread of particle trajectories from the initial trajectory on the basis of the magnetic susceptibility of the particles wherein at least some of the particles in the spread of trajectories are carried in those trajectories beyond the magnet, and, sorting of the particles on the basis of their trajectories.

20. An apparatus for sorting particulate matter comprising:

a device capable of launching particulate matter as unconstrained monolayer of particles moving through a gaseous medium in free space wherein the particulate matter comprises particles having an average maximum size to average minimum size ratio of between 2:1 to 4:1;

a sorter comprising a magnet arranged to generate a constant in time magnetic field, the sorter capable of exposing the unconstrained monolayer to the magnetic field so that motion of at least some of the particles in the unconstrained monolayer is influenced by the magnetic field on the basis of the magnetic susceptibility of the particles to create a spread of particle trajectories, wherein the trajectories are indicative of physical composition of the particles; and wherein the magnet is disposed at a location in a general direction of motion of the unconstrained monolayer and spaced from the device such that at least some of the particles in the spread of trajectories are carried in those trajectories beyond the magnet in the general direction of motion of the unconstrained monolayer.

21. The apparatus according to claim 20 wherein the magnet is disposed at a location higher than the location at which the particulate material is launched.

22. A method of sorting particulate matter comprising:

launching a monolayer feed stream of particulate matter moving with an initial trajectory in a gaseous medium from a mechanism to form an unconstrained monolayer feed stream of particles wherein the particulate matter comprises particles having an average maximum size to average minimum size ratio of between 2:1 to 4:1 and wherein the initial trajectory carries the particles toward a magnet spaced from a launch location on the mechanism from which the particles are launched;

subjecting the monolayer feed stream while in the gaseous medium to a constant in time magnetic field produced by the magnet to cause a spread of particle trajectories from the initial trajectory on the basis of the magnetic susceptibility of the particles;

disposing a plurality of collection devices, one for respective groups of particles of the same trajectory or having a selected range of trajectories in the spread of trajectories, at locations enabling collection of the particles at or near the same height as the launch location; and wherein particles collected in respective collection devices are sorted on the basis of their trajectories.

23. An apparatus for sorting particulate matter comprising:

a device capable of launching particulate matter from a launch location as unconstrained monolayer of particles moving through a gaseous medium in free space wherein the particulate matter comprises particles having an average maximum size to average minimum size ratio of between 2:1 to 4:1;

a sorter comprising a magnet spaced from the device and arranged to generate a constant in time magnetic field, the sorter capable of exposing the unconstrained monolayer to the magnetic field so that motion of at least some of the particles in the unconstrained monolayer is influenced by the magnetic field on the basis of the magnetic susceptibility of the particles to create a spread of particle trajectories, wherein the trajectories are indicative of physical composition of the particles; and a plurality of collection devices, one for respective groups of particles of the same trajectory or having a selected range of trajectories in the spread of trajectories, the collection devices being disposed at locations enabling collection and sorting of the particles at or near the same height as the launch location, wherein the particles collected in respective collection devices are sorted on the basis of their trajectories.

* * * * *